US006221831B1

(12) United States Patent
Emery et al.

(10) Patent No.: US 6,221,831 B1
(45) Date of Patent: Apr. 24, 2001

(54) FREE FLOWING DETERGENT COMPOSITION CONTAINING HIGH LEVELS OF SURFACTANT

(75) Inventors: William Derek Emery, Bebington (GB); Andreas Theodorus Groot, Vlaardingen (NL); Terry Instone, Bebington (GB); Seeng Djiang Liem, Vlaardingen (NL); Kenneth Metcalfe; Richard George Smith, both of Bebington (GB); Gilbert Martin Verschelling, Vlaardingen (NL)

(73) Assignee: Lever Brothers Company, division of Conopco, Inc., New York, NY (US)

( * ) Notice: Subject to any disclaimer, the term of this patent is extended or adjusted under 35 U.S.C. 154(b) by 0 days.

(21) Appl. No.: 09/084,567

(22) Filed: May 26, 1998

(30) Foreign Application Priority Data

May 30, 1997 (GB) ..... 9711352
May 30, 1997 (GB) ..... 9711359
Apr. 24, 1998 (GB) ..... 9808897

(51) Int. Cl.[7] ..... C11D 1/02; C11D 17/06

(52) U.S. Cl. ..... 510/438; 510/445; 510/426; 510/299; 510/434; 510/443; 510/444

(58) Field of Search ..... 510/336, 457, 510/404, 299, 443, 426, 434, 445, 444, 477, 438

(56) References Cited

U.S. PATENT DOCUMENTS

| | | | | |
|---|---|---|---|---|
| 3,849,327 | | 11/1974 | DiSalvo et al. | 252/109 |
| 4,524,010 | | 6/1985 | Reuter et al. | 252/135 |
| 4,639,326 | | 1/1987 | Czempik et al. | 252/91 |
| 4,755,318 | | 7/1988 | Davies et al. | 252/109 |
| 4,828,721 | | 5/1989 | Bollier | 252/8.7 |
| 4,861,503 | | 8/1989 | Hollingsworth et al. | 252/135 |
| 4,900,466 | * | 2/1990 | Atkinson et al. | 510/443 |
| 4,923,628 | * | 5/1990 | Appel et al. | 510/276 |
| 5,002,682 | | 3/1991 | Bragg et al. | 252/99 |
| 5,009,804 | | 4/1991 | Clayton et al. | 252/90 |
| 5,108,646 | | 4/1992 | Beerse et al. | 252/174.25 |
| 5,151,208 | | 9/1992 | Huijben et al. | 252/174.14 |
| 5,496,495 | | 3/1996 | Beck et al. | 252/174.23 |
| 5,569,645 | | 10/1996 | Dinniwell et al. | 510/276 |
| 5,576,277 | | 11/1996 | MacBeath et al. | 510/113 |
| 5,641,741 | * | 6/1997 | Emery et al. | 510/457 |
| 5,646,107 | * | 7/1997 | Emery et al. | 510/457 |
| 5,691,294 | * | 11/1997 | France et al. | 510/349 |
| 5,703,037 | * | 12/1997 | Doumen et al. | 510/444 |
| 5,707,959 | | 1/1998 | Pancheri et al. | 510/444 |
| 5,726,142 | | 3/1998 | Partee et al. | 510/276 |
| 5,739,097 | * | 4/1998 | Bauer et al. | 510/446 |
| 5,856,294 | * | 1/1999 | Emery | 510/456 |
| 5,919,747 | | 7/1999 | Kazuta et al. | 510/444 |

FOREIGN PATENT DOCUMENTS

| | | |
|---|---|---|
| 1070210 | 1/1980 | (CA) . |
| 2 050 560 | 4/1971 | (DE) . |
| 164 514 | 12/1985 | (EP) . |
| 168 102 | 1/1986 | (EP) . |
| 220 024 | 4/1987 | (EP) . |
| 221 776 | 5/1987 | (EP) . |
| 242138 | 10/1987 | (EP) . |
| 266 863 | 5/1988 | (EP) . |
| 289 311 | 11/1988 | (EP) . |
| 289 312 | 11/1988 | (EP) . |
| 289 313 | 11/1988 | (EP) . |
| 352 135 | 7/1989 | (EP) . |
| 341 072 | 11/1989 | (EP) . |
| 342 043 | 11/1989 | (EP) . |
| 351 937 | 1/1990 | (EP) . |
| 228 011 | 4/1990 | (EP) . |
| 367 339 | 5/1990 | (EP) . |
| 384 070 | 8/1990 | (EP) . |
| 390 251 | 10/1990 | (EP) . |
| 390 287 | 10/1990 | (EP) . |

(List continued on next page.)

OTHER PUBLICATIONS

Derwent abstract of JP 8027498.
Derwent abstract of JP 2726898.
Derwent abstract of JP 7197084.
Derwent abstract JP 6179892.
Derwent abstract of DE 3131668 with Miyazaki et al., U.S. 4,405,484.
Derwent abstract of PCT patent application WO 96/23864.
Derwent abstract of European patent application EP 219 328.
Derwent abstract of European patent application EP 168 102.
Derwent abstract of German patent application DE 4229660.
Derwent abstract of German patent application DE 3545947.
Derwent abstract of German patent application DE 3424299.
Derwent abstract of German patent application DE 19601841.
Derwent abstract of Japanese patent application JP 4363400.
Derwent abstract of Japanese patent application JP 7011293.
Derwent abstract of Japanese patent application JP 7286195.
Derwent abstract of Japanese patent application JP 7286196.
Derwent abstract of Japanese patent application JP 7286197.
Derwent abstract of Japanese patent application JP 7286198.
Derwent abstract of Japanese patent application JP 7258693.
Derwent abstract of Japanese patent application JP 7268397.
Derwent abstract of Japanese patent application JP 7268399.
Derwent abstract of Japanese patent application JP 7268400.
Derwent abstract of Japanese patent application JP 8003600.

*Primary Examiner*—William Krynski
*Assistant Examiner*—Dawn L. Garrett
(74) *Attorney, Agent, or Firm*—Rimma Mitelman

(57) ABSTRACT

A free-flowing built particulate laundry detergent composition comprises:

(i) at least 27% by weight of non-soap organic detergent surfactant, (ii) one or more detergency builders, but not more than 7% by weight of alkali metal aluminosilicate, the weight ratio of surfactant to builder being at least 1.2:1.

17 Claims, No Drawings

FOREIGN PATENT DOCUMENTS

| | | |
|---|---|---|
| 438 320 A2 | 1/1991 | (EP) . |
| 420 317 | 4/1991 | (EP) . |
| 425 277 | 5/1991 | (EP) . |
| 430 328 | 6/1991 | (EP) . |
| 437 950 A2 | 7/1991 | (EP) . |
| 437 950 A3 | 7/1991 | (EP) . |
| 451 894 | 10/1991 | (EP) . |
| 470 250 | 2/1992 | (EP) . |
| 477 974 | 4/1992 | (EP) . |
| 534 525 | 9/1992 | (EP) . |
| 521 635 | 1/1993 | (EP) . |
| 550 086 | 7/1993 | (EP) . |
| 560 395 | 9/1993 | (EP) . |
| 562 628 | 9/1993 | (EP) . |
| 593 014 | 4/1994 | (EP) . |
| 618 290 | 5/1994 | (EP) . |
| 639 637 | 2/1995 | (EP) . |
| 639 639 | 2/1995 | (EP) . |
| 643 130 | 3/1995 | (EP) . |
| 653 481 | 5/1995 | (EP) . |
| 2 356 718 | 1/1978 | (FR) . |
| 1303479 | 1/1973 | (GB) . |
| 1 470 250 | 4/1977 | (GB) . |
| 1 473 202 | 5/1977 | (GB) . |
| 2 123 044 | 1/1984 | (GB) . |
| 2 301 835 | 12/1996 | (GB) . |
| 2 304 726 | 3/1997 | (GB) . |
| 8 027498 | 1/1996 | (JP) . |
| 90/02165 | 3/1990 | (WO) . |
| 92/07060 | 4/1992 | (WO) . |
| 93/02168 | 2/1993 | (WO) . |
| 93/18124 | 9/1993 | (WO) . |
| 93/20172 | 10/1993 | (WO) . |
| 94/01521 | 1/1994 | (WO) . |
| 95/02682 | 1/1995 | (WO) . |
| 96/34084 | 10/1995 | (WO) . |
| 96/06916 | 3/1996 | (WO) . |
| 96/06917 | 3/1996 | (WO) . |
| 96/10070 | 4/1996 | (WO) . |
| 96/22355 | 7/1996 | (WO) . |
| 96/38529 | 12/1996 | (WO) . |
| 96/38530 | 12/1996 | (WO) . |
| 97/32002 | 9/1997 | (WO) . |
| 97/32005 | 9/1997 | (WO) . |
| 96/37599 | 11/1999 | (WO) . |

* cited by examiner

FREE FLOWING DETERGENT COMPOSITION CONTAINING HIGH LEVELS OF SURFACTANT

TECHINCAL FIELD

The present invention relates to built particulate laundry detergent compositions containing especially high levels of surfactant while retaining free-flowing properties.

BACKGROUND

High levels of organic detergent surfactant (active) are sometimes required in laundry detergent compositions, particularly in compositions intended for washing by hand, to give effective soil removal. However, it has been found that problems of poor powder properties can be encountered in high-active compositions, for example, powder stickiness leading to agglomeration and poor flow.

Flow properties are improved by the presence of inorganic materials having a good carrying capacity for mobile organic surfactants, but the higher the intended surfactant level, the less room there is in the formulation for inorganic material.

Clearly it is preferable that the inorganic material included for this purpose should also itself have functionality, for example, as a detergency builder. However, one of the most effective and popular detergency builders, sodium tripolyphosphate, has a relatively poor carrying capacity for surfactants unless spray-dried.

In order to improve the liquid carrying capacity of particulate detergent compositions to allow a high active level, it is known in the art to include a relatively high proportion of material, typically builder material, which has a better carrying capacity than sodium tripolyphosphate. For example, zeolite may be used in this role. However, zeolite is insoluble and its presence may lead to residues on washed fabrics. The present inventors have therefore sought to provide particulate detergent compositions having a high surfactant content, yet having acceptable or good powder properties, without the need to incorporate substantial quantities of zeolite.

Traditionally detergent powders contain a base powder, prepared by spray-drying or granulation or a combination of such processes, consisting of structured particles containing all, or the major part of, the surfactant and builder in the formulation. Other ingredients not suitable for incorporation in the base powder, such as bleaches, enzymes, heat-sensitive nonionic surfactants, antiredeposition polymers, dye transfer inhibiting polymers, foam control granules, and perfumes are subsequently sprayed on to, or dry mixed with, the base powder.

The present inventors have discovered that free-flowing powders having higher surfactant to builder ratios than have previously been possible may be prepared, if the base powder is partly or wholly replaced by, or supplemented with, separate granular components in which certain ingredients are concentrated, or segregated from one another.

DEFINITION OF THE INVENTION

The present invention accordingly provides a free-flowing built particulate laundry detergent composition comprising:

(i) at least 27% by weight of non-soap organic detergent surfactant, (ii) one or more detergency builders, but not more than 7% by weight of alkali metal aluminosilicate, the weight ratio of surfactant (i) to builder (ii) being at least 1.2:1.

DETAILED DESCRIPTION OF THE INVENTION

The compositions of the invention are characterised by good flow properties despite the high surfactant content and high ratio of surfactant to builder. This ratio is at least 1.2:1, and may be at least 1.5:1 or even higher.

The total content of non-soap surfactant in the compositions of the invention is at least 27% by weight, preferably from 27 to 50% by weight. The surfactant content is preferably at least 28% by weight, and more preferably at least 30% by weight. Compositions having a surfactant content of 35% by weight or more are of especial interest.

The surfactant (i) preferably comprises anionic surfactant, nonionic surfactant or a combination of the two. If both anionic and nonionic surfactants are present, the weight ratio of anionic surfactant to nonionic surfactant is preferably at least 1:1, and more preferably at least 1.5:1. Formulations containing anionic surfactant only, or nonionic surfactant only, are also of interest. Other surfactant types, for example, cationic, amphoteric or zwitterionic, may also be present. Examples of suitable surfactants are listed below.

Soap, if present, should not be taken into account when calculating the surfactant to builder ratio.

The builder (ii) may be any true detergency builder having a significant calcium binding capacity, whether inorganic or organic. The term builder as used herein specifically excludes alkali metal carbonates and soluble alkali metal silicates, both of which are sometimes referred to elsewhere as builders. Those materials may of course be present, but should not be taken into account when calculating the surfactant to builder ratio.

Similarly, sequestrants present in minor amounts as bleach stabilisers, for example aminophosphonates, should not be taken into account when calculating the surfactant to builder ratio.

Preferred inorganic builders are selected from alkali metal phosphates and layered silicates. The preferred alkali metal phosphate is sodium tripolyphosphate. Layered silicate is available as SKS-6 from Hoechst.

Alkali metal aluminosilicates may also be present, but only in an amount not exceeding 7% by weight. Preferred alkali metal aluminosilicates are zeolite 4A, and zeolite MAP (maximum aluminium zeolite P, as described in EP 384 070B (Unilever), available as Doucil (Trade Mark) A24 from Crosfield.

Preferred organic builders are di- and tricarboxylic acid salts, for example, citrates, more especially trisodium citrate; and polycarboxylate polymers, for example, acrylate and acrylate/maleate polymers, more especially Sokolan (Trade Mark) CP5 from BASF.

The total level of detergency builder in the compositions of the invention will generally be lower than in known formulations, for example, it may be as low as 4% by weight. However, it is preferably at least 10% by weight, more preferably at least 20% by weight, provided that the weight ratio of surfactant to builder is always at least 1.2:1.

The compositions of the present invention are in the form of free-flowing particulates or powders. Preferred compositions of the invention have a dynamic flow rate of at least 100 ml/s, preferably at least 110 ml/s and ideally at least 120 ml/s. A method for measuring dynamic flow rate is given below. It has not previously been possible to prepare compositions having such high surfactant levels and high surfactant to builder ratios that are in the form of free-flowing powders.

Compositions of the invention may have any bulk density ranging from very low to very high.

Preferred compositions of the invention have bulk densities within the range of from 300 to 1000 g/l, preferably from 350 to 1000 g/l, more preferably from 450 to 900 g/litre. High bulk density compositions (600 g/l and above) may be prepared in accordance with the invention.

Granules and Adjuncts

As previously indicated, in the compositions of the invention the base powder is partly or wholly replaced by, or supplemented with, separate granular components in which certain ingredients are concentrated and/or segregated from one another. This approach has made possible the preparation, in free-flowing powder form, of compositions which, if prepared by known methods, could only be obtained in the form of poorly flowing powders, doughs or sticky pastes.

Examples of such granules include:

granules containing a high level of anionic surfactant ("anionic granules"), granules containing a high level of nonionic surfactant ("nonionic granules"), and builder granules containing little or no surfactant.

Preferred compositions of the invention comprise at least one granular component selected from (a) granules containing at least 60% by weight of anionic surfactant, (b) granules containing at least 20% by weight of nonionic surfactant, and (c) builder granules, optionally containing up to 10% by weight of surfactant.

Especially preferred compositions of the invention comprise at least two different granular components selected from (a) granules containing at least 60% by weight of anionic surfactant, (b) granules containing at least 20% by weight of nonionic surfactant, (c) builder granules, optionally containing up to 10% by weight of surfactant, and (d) a spray-dried or granulated detergent base powder containing surfactant and builder.

The Anionic Surfactant Granules (a)

The anionic surfactant granules preferably comprise from 60 to 99% by weight, more preferably from 65 to 96% by weight, of anionic surfactant.

The anionic surfactant granules may also contain nonionic surfactant. The anionic surfactant granules may also contain minor ingredients such as water, sodium carboxymethylcellulose, fluorescers, dyes, etc.

The anionic surfactant granules may optionally comprise from 0 to 40% by weight of detergency builder. The builder material may comprise soluble builder such as salts (preferably alkali metal salts, particularly preferably sodium salts) of tripolyphosphate, carbonate, silicate, sesquicarbonate, citrate or mixtures thereof, or burkeite (a double salt of sodium sulphate and sodium carbonate), NTA, polycarboxylic acid monomer, polycarboxylic acid polymer, polycarboxylic acid/maleic acid copolymer or mixtures thereof. Preferred builders have already been indicated above.

The builder may comprise insoluble builder such as aluminosilicate. The aluminosilicate may comprise zeolite, in particular zeolite MAP, zeolite 4A, amorphous aluminosilicate and mixtures thereof. It is particularly preferred, however, that the quantity of aluminosilicate builder is low, in order to keep within the overall limits for aluminosilicate content in the whole composition. Preferably, aluminosilicate builder provides less than 25% by weight of the anionic surfactant particles, more preferably less than 15%.

The anionic surfactant granules may be manufactured by any suitable process. Preferably, such granules are manufactured by mixing the components in a high speed mixer to agglomerate the components. Suitable mixers will be discussed further below.

Processes for producing granules containing high quantities of anionic surfactant are set out in WO 96/06916A and WO 96/06917A (Unilever).

The method of WO 97/32002A (Unilever) is particularly preferred. In this method, a paste material comprising water and an anionic surfactant, or a mixture of acid surfactant precursor and alkaline neutralising agent, is fed into a drying zone, the paste material being heated in the drying zone to reduce the water content thereof and the paste material being subsequently cooled in a cooling zone to form detergent particles, a layering agent being introduced into the cooling zone during the cooling step. Alternatively, a paste material comprising water and an anionic surfactant, or a mixture of acid surfactant precursor and alkaline neutralising agent, are fed into a drying zone, the material being heated in the drying zone to reduce the water content thereof and the material being subsequently cooled in a cooling zone to form detergent particles, the material being treated in the cooling zone with a stream of cooling gas. This process can provide detergent particles comprising at least 60% by weight of the particle of an anionic surfactant and not more than 5% by weight of the particle of water. The particles are coated with layering agent.

The detergent particles may comprise anionic surfactant in an amount of at least 60% by weight of the particle, the particles being coated with layering agent and having a porosity of from 0 to 25% by volume of the particle and a particle size distribution such that at least 80% of the particles have a particle size of 180–1500 microns. The layering agent may comprise an aluminosilicate, a silica or a mixture thereof. The layering agent may be dosed into the cooling zone at a weight ratio of from 1:5 to 1:20 relative to the finished particles. The anionic surfactant may be formed in situ by neutralisation of a free acid with neutralising agents such as sodium hydroxide solution or sodium carbonate.

The Nonionic Surfactant Granules (b)

The nonionic surfactant granules preferably comprise at least 20% by weight of nonionic surfactant.

The quantity of aluminosilicate builder should be less than 10% by weight. This helps to avoid unfavourable generation of residues and poor dispersing properties in wash water.

The nonionic surfactant particles preferably contain less than 10% by weight of anionic surfactant, and preferably substantially no anionic surfactant.

Nonionic surfactant particles suitable for use in the present invention generally fall into one of two classes.

The first class comprises nonionic surfactant carried on water-soluble carrier material. Suitable carrier materials include burkeite, sodium sesquicarbonate, sodium carbonate, sodium sulphate and mixtures thereof. A nonionic surfactant granule comprising water-soluble carrier preferably comprises from 20 to 50% by weight, preferably from 25 to 40% by weight, of nonionic surfactant.

The water-soluble carrier material is preferably present at a level exceeding 40% by weight, preferably 60% by weight or more.

The second class of nonionic surfactant granule comprises water-insoluble carrier material. The insoluble carrier material may comprise silica or aluminosilicate, such as zeolite. However, it is essential that, if aluminosilicate is present, the quantity is less than 10% by weight. Where an insoluble carrier material is used, the quantity of nonionic surfactant may exceed 55% by weight of the granule.

Structuring agents such as polyethylene/poly-propylene glycol of average molecular weight in the region 4000–12000, sodium soap, polyvinyl alcohol of average molecular weight in the range 30 000–200 000, alkaline metal succinate etc. may be present. The preferred quantity of structuring agent is in the region of from 0.5 to 10% by weight.

Nonionic-surfactant-containing granules comprising 55% by weight or more of nonionic surfactant, at least 5% by weight of silica of oil absorption capacity of 1.0 ml/g and less than 10% by weight of aluminosilicate are disclosed in our copending application of even date (reference C3777) entitled "Detergent Compositions Containing Nonionic Surfactant Granule". These granules can be manufactured by mixing together components in a granulator (for example an Eirich RVO2 Granulator). Alternatively, 70 to 100% by weight of the solid components and 70 to 95% by weight of the nonionic surfactant can be mixed together in a first step, the remainder of the solid components and nonionic surfactant being added in a second step, preferably under moderate shear. In the second process, the majority of the structurant is preferably added in the second step.

As indicated previously, the nonionic surfactant granules are preferably present in an amount of from 1 to 50%, preferably from 1 to 30%, by weight of the composition. They may suitably provide 20% or more of the composition.

The Builder Granules (c)

Builder granules suitable for use in the compositions of the invention may contain soluble builder such as sodium tripolyphosphate, sodium carbonate, sodium silicate, NTA, sodium sesquicarbonate, Burkeite, sodium citrate, polycarboxylic acid monomer, polycarboxylic acid polymer/copolymer or mixtures thereof.

The builder granules may also comprise aluminosilicate, preferably crystalline aluminosilicate such as zeolite, provided that the overall limits for zeolite content in the formulation are not exceeded.

The most preferred builders for use in the compositions of the present invention have already been indicated above.

The builder granule is preferably present in an amount of from 5 to 80% by weight, and may suitably represent 15% by weight or more of the composition, more preferably 18% by weight or more.

The builder granule optionally contains additional nonionic and/or anionic surfactant. The total quantity of surfactant in the builder granule is preferably less than 10% by weight.

The builder granule may also comprise layered silicate, available, for example, as SKS-6 (Hoechst).

Any suitable means may be used to prepare the builder granules. For example, the builder granules may be manufactured by spray drying a slurry of the components. Alternatively, the components may be placed in a high speed mixer/densifier and granulated in the presence of liquid binder such as water or solution of polymer, such as builder polymer, or solution of salt, such as silicate.

Detergent Base Powders (d)

The term "detergent base powder" as used herein is intended to mean a homogeneous granulate consisting of structured particles containing anionic and/or nonionic surfactant plus detergency builder and other ingredients, but the surfactants are not present at such high levels as in the high-active granules discussed above, or at such low levels as in the builder granules discussed above.

Base powders may be manufactured by spray-drying or agglomeration techniques, as are well-known in the art. High bulk density base powders may be prepared by spray-drying followed by densification, or by wholly non-tower granulation or agglomeration routes.

A base powder suitable for use in the compositions of the invention may suitable contain at least 5% by weight of anionic surfactant, preferably from 10 to 30% by weight. Nonionic surfactant may also be present, typically in amounts of from 5 to 30% by weight of the base powder. The content of builder in the base powder may suitably be at least 50% by weight.

Postdosed Ingredients

The detergent composition of the present invention may consist only of "base ingredients" such as the anionic granule, the nonionic granule, the builder granule and the detergent base powder described above.

However, other detergent ingredients may be added by postdosing to provide additional detergent benefits.

Examples of ingredients which may be postdosed are bleach ingredients, bleach precursors, bleach catalysts, bleach stabilisers, photobleaches, alkali metal carbonate, water-soluble crystalline or amorphous alkaline metal silicates, layered silicates, anti-redeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

Preferably the detergent composition contains 40 to 85% by weight, in total, of the "base ingredients", ie the totality of granules selected from anionic surfactant granules, nonionic surfactant granules, builder granules, detergent base powder present; the balance, if any, being postdosed ingredients.

The compositions of the invention may, if desired, contain more than one type of anionic surfactant granule, and/or more than one type of nonionic surfactant granule, and/or more than one type of builder granule.

In the present specification, the term "granule" is used to denote a solid particle of size greater than 200 micrometers. Preferably, such granules will be the direct product of a spray drying or agglomeration process.

Detergent Ingredients

Some preferred ingredients of the compositions of the invention have been discussed above. The following is a more thorough, but not totally exhaustive, listing of possible ingredients suitable for incorporation in the compositions of the invention.

The detergent compositions of the invention will contain, as essential ingredients, one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Anionic surfactants may be produced by neutralising a liquid acid precursor with alkali, such as sodium hydroxide solution or solid sodium carbonate in situ in the granulation process.

The liquid acid precursor of an anionic surfactant may be selected from the acid precursors of linear alkyl benzene sulphonate, alpha-olefin sulphonate, internal olefin sulphonate, alkyl ether sulphate or fatty acid ether sulphate and combinations thereof.

The anionic surfactants may be primary or secondary alcohol sulphates. Linear or branched primary alcohol sulphates having 10 to 20 carbon atoms are particularly preferred. These surfactants can be obtained by sulphation of the corresponding primary or secondary alcohols, of synthetic or natural origin, followed by neutralisation. Because the acid precursors of alcohol sulphates are chemically unstable, they are not commercially available and they have to be neutralised as quickly as possible after their manufacture.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are long or short hydrocarbyl chains, typically alkyl, hydroxyalkyl or ethoxylated alkyl groups, and X is a solubilising cation (for example, compounds in which $R_1$ is a $C_{8-22}$ alkyl group, $R_2$ is a methyl group, and $R_3$ and $R_4$, which may be the same or different, are methyl or hydroxyethyl groups); and cationic esters (for example, choline esters).

In the compositions of the invention, the total quantity of detergent surfactant in the composition is at least 27% by weight, preferably at least 28% by weight, more preferably at least 30% by weight. The composition may comprise up to 60% by weight of detergent surfactant, preferably up to 50% by weight.

Preferably, the quantity of anionic surfactant is in the range of from 5 to 50% by weight of the total composition. More preferably, the quantity of anionic surfactant is in the range of from 8 to 35% by weight.

Preferably, the quantity of nonionic surfactant is in the range of from 5 to 25% by weight, more preferably from 5 to 20% by weight.

The compositions of the present invention contain from 10 to 70%, preferably from 15 to 70% by weight, of detergency builder. Preferably, the quantity of builder is in the range of from 15 to 50% by weight.

The detergent composition of the invention may contain a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5\ M_2O.Al_2O_3.0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

The zeolite used in the compositions of the present invention may be the commercially available zeolite A (zeolite 4A) now widely used in laundry detergent powders. However, according to a preferred embodiment of the invention, the zeolite incorporated in the compositions of the invention is maximum aluminium zeolite P (zeolite MAP) as described and claimed in EP 384 070B (Unilever), and commercially available as Doucil (Trade Mark) A24 from Crosfield Chemicals Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20. especially preferred is zeolite MAP having a silicon to aluminium ratio not exceeding 1.07, more preferably about 1.00. the calcium binding capacity of zeolite MAP is generally at least 150 mg CaO per g of anhydrous material.

The detergent composition may contain crystalline or amorphous water-soluble alkali metal silicate, preferably sodium silicate having a $SiO_2$:$Na_2O$ mole ratio within the range of from 1.6:1 to 4:1, 2:1 to 3.3:1.

The water-soluble silicate may be present in an amount of from 1 to 20 wt %, preferably 3 to 15 wt % and more preferably 5 to 10 wt %, based on the total composition.

As well as the crystalline aluminosilicate builders already mentioned, other inorganic or organic builders may be present. Inorganic builders that may be present include sodium carbonate, layered silicate, amorphous aluminosilicates, and phosphate builders, for example, sodium orthophosphate, pyrophosphate and tripolyphosphate.

Organic builders that may additionally be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiac-etates, alkyl- and alkyenylmalonates and succinates; and sulphonated fatty acid salts.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Detergent compositions according to the invention may also suitably contain a bleach system. The compositions of the invention may contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates.

The sodium percarbonate may have a protective coating against destabilisation by moisture. Sodium percarbonate having a protective coating comprising sodium metaborate and sodium silicate is disclosed in GB 2 123 044 .(Kao).

The peroxy bleach compound, for example sodium percarbonate, is suitably present in an amount of from 5 to 35 wt %, preferably from 10 to 25 wt %.

The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N, N, N', N'-tetracetyl ethylenediamine (TAED).

A bleach stabiliser (heavy metal sequestrant) may also be present. Suitable bleach stabilisers include ethylenediamine tetraacetate (EDTA), ethylenediamine disuccinate (EDDS), and the aminopolyphosphonates such as ethylenediamine tetramethylene phosphonate (EDTMP) and diethylenetriamine pentamethylene phosphonate (DETPMP).

The compositions of the present invention may also include a bleach catalyst, such as manganese cyclononane derivative.

The compositions of the present invention may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22.

The compositions of the invention may also contain dye transfer inhibiting polymers, for example, polyvinyl pyrrolidone (PVP), vinyl pyrrolidone copolymers such as PVP/PVI, polyamine-N-oxides, PVP-NO etc.

A powder structurant, for example, a fatty acid (or fatty acid soap), a sugar, an acrylate or acrylate/maleate polymer may be included in the granular components. A preferred powder structurant is fatty acid soap, suitably present in an amount of from 1 to 5 wt %.

Other materials that may be present in detergent compositions of the invention include antiredeposition agents such as cellulosic polymers; fluorescers; photobleaches; inorganic salts such as sodium sulphate; foam control agents or foam boosters as appropriate; enzymes (proteases, lipases, amylases, cellulases); dyes; coloured speckles; perfumes; and fabric conditioning compounds.

Ingredients which are normally but not exclusively postdosed, may include bleach ingredients, bleach precursor, bleach catalyst, bleach stabiliser, photobleaches, alkali metal carbonate, water-soluble crystalline or amorphous alkaline metal silicate, layered silicates, antiredeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

It is particularly preferred to include sodium carbonate. This has the advantage that it helps to structure the granule, can act to control the pH of the detergent composition when dissolved and acts as a builder. Preferably 5–30% by weight sodium carbonate are present. Minor ingredients such as layering agents (for example zeolite, Alusil (trade mark) or clay) may be present at a level 0.1–10%.

EXAMPLES

The invention will be further illustrated by the following non-limiting Examples, in which parts and percentages are by weight unless otherwise stated.

Measurement of Dynamic Flow Rate

The dynamic flow-rate or DFR is measured by the following method.

The apparatus used consists of a cylindrical glass tube having an internal diameter of 35 mm and a length of 600 mm. The tube is securely champed in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow-rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR=V/t$$

The averaging and calculation are carried out electronically and a direct read-out of the DFR value obtained.

Example 1

Example 1, Comparative Example A

This Example shows how a formulation containing a very high surfactant level and excellent powder properties can be prepared by "topping up" a base powder having a medium surfactant level with a high-active granule, without loss of powder properties.

Base powder F1 was prepared by spray-drying to the following formulation:

| Component | F1 |
|---|---|
| NaLAS | 37.29 |
| STP | 22.99 |
| Sodium sulphate | 17.05 |
| Silicate | 10.85 |
| SCMC | 0.58 |
| Water | 10.22 |
| Miscellaneous | 1.03 |
| BD [g/l] | 315 |
| DFR [ml/s] | 84 |

An anionic granule A1 containing a high level of anionic surfactant were prepared by a non-spray-drying process as follows. Sodium linear alkyl benzene sulphonate particles (NaLAS) were produced by neutralising LAS acid with sodium carbonate. Furthermore, zeolite MAP was dosed as a layering agent and optionally sodium sulphate was dosed as well. A 2.0 $m^2$ VRV flash-drier machine was used having three equal jacket sections. Dosing ports for liquids and powders were situated just prior to the first hot section, with mid-jacket dosing ports available in the final two sections. Zeolite was added via this port in the final section. An electrically-powered oil heater provided the heating to the first two jacket sections. Ambient process water at 15° C. was used for cooling the jacket in the final section. Make-up air flow through the reactor was controlled between 10 and 50 $m^3$/kg hr by opening a bypass on the exhaust vapour extraction fan. All experiments were carried out with the motor at full-speed giving a tip speed of about 30 m/s. Screw-feeders were calibrated to dose sodium carbonate, zeolite 4A, and zeolite MAP for layering. The sodium carbonate, zeolite 4A and liquids were added just prior to the first hot section and zeolite MAP for layering was added into the third section which was cold. The minimum level of zeolite MAP was added to give free-flowing granules leaving the drier.

A jacket temperature of 145° C. was used in the first two sections, with an estimated throughput of components 60 to 100 kg/hr. A degree of neutralisation of alkyl benzene sulphonate of greater than 95 was achieved.

The composition of the granules is shown below.

| Ingredient (wt %) | A1 |
|---|---|
| Na LAS | 70 |
| Zeolite 4A | 20 |
| Zeolite MAP | 5 |
| Water, Salts, NDOM | 5 |

Base powder F1 was mixed with other granular components as set out below and exhibited properties as specified:

| Ingredients [wt %] | A | 1 |
|---|---|---|
| Base powder F1 | 63.95 | 63.95 |
| Anionic granule A1 | | 21.70 |
| Sodium carbonate | 17.50 | 14.35 |
| Sodium sulphate | 18.55 | |
| Surfactant level (% wt) | 23.8 | 39.0 |
| Builder level (% wt) | 14.7 | 14.7 |
| Zeolite level (% wt) | 0 | 6.5 |
| Surfactant:builder ratio | 1.62 | 1.84 |
| BD [g/l] | 475 | 443 |
| DFR [ml/s] | 103 | 126 |

Comparative Example A was prepared by using the relatively high-active base powder F1, and postdosing inorganic salts. This powder which has a surfactant level lower than 27% has a flow rate only just above 100 ml/s However, Composition 1 which was similar to composition A but containing a very large quantity of anionic surfactant, has substantially better flow properties despite its very high surfactant level of 39%.

Example 2

Base powder F2 was prepared by making a slurry containing water, NaLAS, STP, silicate, sodium sulphate, SCMC and fluorescer. This slurry was spray-dried in a countercurrent spray-drying tower, resulting in the following composition:

| Ingredients | F2 (wt %) |
|---|---|
| NaLAS | 37.9 |
| STP | 23.3 |
| Silicate | 11.0 |
| Sodium sulphate | 17.3 |
| Moisture, minors | 10.5 |

Builder granule B1 was prepared by continuously dosing sodium tripolyphosphate (STP) in a Schugi Flexomix, while spraying on a 10% alkaline silicate solution. The resulting powder was cooled in a fluid bed and collected. The following powder was obtained:

| Ingredients | Builder granule B1 [wt %] |
|---|---|
| STP | 89.3 |
| Silicate | 1.8 |
| Moisture, minors etc | 8.9 |

Nonionic granule N1 was prepared by a process route consisting of a Lodige CB30, followed by a Niro fluid bed and a Mogensen sieve. The Lodige CB30 was operated at 1500 rpm. Water was used to cool the CB30 jacket during the process. The air flow in the Niro fluid bed was 900–1000 $m^3$/hr. The total flow of powder exiting the process was in the order of 600 kg/h.

Silica (Sorbosil (Trade Mark) TC15 ex Crosfield) was continously dosed into the CB30, into which also a mixture of nonionic surfactant (Lutensol AO7 ex BASF) and fatty acid (Pristerene 4916 ex Unichema) was dosed via dosing pipes. At the same time 50% NaOH was dosed to neutralise the fatty acid. This set of solid and liquid materials was mixed and granulated in the CB30 after which the resulting powder was entered in the fluid bed and cooled with ambient air. Fines were filtered from the air stream with a cyclone and filter bags. Coarse particles (>1400 $\mu$m) were separated from the product by the Mogensen sieve.

| Composition [wt %] | N1 |
|---|---|
| Sorbosil TC15 | 30.0 |
| Lutensol AO7 | 55.0 |
| Soap | 13.1 |
| Water | 1.9 |

With these ingredients the following powder having very high surfactant contents and excellent flow properties was assembled:

| Formulation | 2 |
|---|---|
| F2 | 60.2 |
| B1 | 12.2 |
| N1 | 27.6 |
| Total surfactant (% wt) | 33 |
| Builder (% wt) | 25 |
| Zeolite (% wt) | 0 |
| Surfactant:builder ratio | 1.52 |
| Anionic:nonionic ratio | 1.5 |
| BD [g/l] | 353 |
| DFR [ml/s] | 122 |

Examples 3 to 5

Builder granule B2 was produced by continuously dosing zeolite MAP, granular trisodium citrate and 40% Sokolan CP5 solution into a Lodige CB30 recycler. The CB30 was operated at 1500 rpm. The exiting powder was led through a Lödige KM300 ploughshare (120 rpm), in which densification took place. The resulting powder was dried in a fluid bed with an air temperature of 110° C. The composition of the resulting builder granule was:

| Ingredients [wt %] | B2 |
|---|---|
| Zeolite MAP (anh) | 41.6 |
| Trisodium citrate | 31.3 |
| Sokolan CP5 | 12.2 |
| Water etc. | 14.9 |

Nonionic granules N2 were produced by first spray-drying a mixture of carbonate, bicarbonate, citrate and Sokolan CP5. The spray-dried material was dosed into a Lodige FM300 D after which nonionic was sprayed on. The Lodige was operated at a speed of 120 rpm with the choppers switched off. Spray on was carried out for 12 minutes. The final composition was as follows:

| Ingredients | N2 |
|---|---|
| Synperonic A7 | 25.4 |
| $NaHCO_3$ | 31.8 |
| $Na_2CO_3$ | 31.8 |
| Sokolan CP5 | 8.0 |
| Water, minors etc. | 3.0 |

PAS granules A2 were produced by drying a primary alcohol sulphate (PAS) paste containing 70% neutralised cocoPAS and 30% water in a dryer/granulator supplied by VRV SpA, Italy, as follows. The temperature of the material fed into the drying zone was set at 60° C. and a small negative pressure was applied to the drying zone. A throughput in the flash drier of 120 kg/hr of paste was used. The temperature of the wall of the drying zone was initially 140° C. The heat transfer area of the drying and cooling zones was 10 $m^2$ and 5$m^2$ respectively. The temperature of the wall of the drying zone was raised in steps to 170° C. Correspondingly, the throughput was increased in steps to 430 kg/hr at 170° C. The particles then passed to a cooling zone operated at a temperature of 30° C.

The formulations of the PAS granules (weight %) were as follows:

| | A2 |
|---|---|
| cocoPAS | 90 |
| water, NDOM etc | 5 |

LAS granules A1 were produced as described in earlier Examples.

These granules were mixed with other post dose materials to make products according to the invention:

| Formulation | 3 | 4 | 5 |
|---|---|---|---|
| B2 | 5 | | 10 |
| N1 | 80 | | 29 |
| N2 | | 38.6 | |
| A1 | | 26 | |
| A2 | | | 17.8 |
| Granular citrate | | | 7.6 |
| Dense carbonate | 15 | 1.8 | 2 |
| Percarbonate | | 19.00 | 19.00 |
| TAED | | 5 | 5 |

-continued

| Formulation | 3 | 4 | 5 |
|---|---|---|---|
| EAG adjunct | | 1.7 | 1.7 |
| SCMC | | 0.6 | 0.6 |
| Fluorescer adjunct | | 1.3 | 1.3 |
| Nabion 15 | | 5 | 5 |
| Dequest 2047 | | 1 | 1 |
| Total surfactant (%) | 44.0 | 28.0 | 32.0 |
| Builder (wt %) | 4.26 | 9.59 | 15.35 |
| Zeolite (wt %) | 2.1 | 6.5 | 4.2 |
| Surfactant/builder | 10.34 | 2.92 | 2.08 |
| Anionic/nonionic | 0 | 1.86 | 1.00 |
| BD [g/l] | 646 | 750 | 682 |
| DFR [ml/s] | 137 | 118 | 134 |

Examples 6 and 7

Two particulate detergent compositions as shown in the table below were manufactured as follows.

Base powder F3 was prepared by dosing the listed components into a high-speed Fukae batch granulator and granulating. The sodium LAS in the base powder was prepared by in situ neutralisation of LAS acid with sodium carbonate. The materials were granulated until powder with good particle size was obtained. If necessary, the powder was layered with zeolite.

LAS granules A3 were prepared by a method similar to that described in Example 1, to the following formulation:

| Ingredient (wt %) | A3 |
|---|---|
| Na LAS | 81 |
| Zeolite 4A | 10 |
| Sodium carbonate | 5 |
| Water | 2 |
| Salts, NDOM | 3 |

The LAS granules A3 were dry-mixed in a low shear mixer with the base powders produced in the Fukae granulator to provide detergent compositions having the bulk densities indicated.

Good DFR values were obtained, indicating low stickiness in the products.

As can be seen below, compositions having very high active (total surfactant) levels, and very high quantities of sodium tripolyphosphate, can be prepared as free-flowing powders. These compositions have good flow rates in spite of the presence of little or no zeolite.

| Example | 6 | 7 |
|---|---|---|
| Base powder F3 | | |
| STP | 29.0 | 29.0 |
| Sodium Carbonate | 17.1 | 17.1 |
| NaLAS | 18.3 | 18.3 |
| SCMC | 1.0 | 1.0 |
| Water, minors | 1.0 | 1.0 |
| Postdosed | | |
| Granular sodium carbonate | 4.8 | |
| Enzymes, speckles, etc | 2.0 | 0.6 |
| LAS granules A3 | 26.8 | 33.0 |

-continued

| Example | 6 | 7 |
|---|---|---|
| Final Properties | | |
| Total surfactant level (wt %) | 40 | 45 |
| Builder level (wt %) | 31.7 | 32.3 |
| Zeolite level (wt %) | 2.7 | 3.3 |
| Surfactant:builder ratio | 1.26 | 1.39 |
| Bulk Density [g/l] | 895 | 896 |
| DFR [ml/s] | 135 | 135 |

[1]Trade Mark: acrylic/maleic copolymer ex BASF

Examples 8 and 9

AOS granules A4 were produced by drying an AOS paste containing 70% neutralised AOS and 30% water in a dryer/granulator supplied by VRV SpA, Italy. The temperature of the material fed into the drying zone was set at 600° C. and a small negative pressure was applied to the drying zone. The temperature of the wall of the drying zone was initially 140° C. The heat transfer areas of the drying and cooling zones were 0.8 $m^2$ and 0.4 $m^2$ respectively. The temperature of the wall of the drying zone was raised in steps to 155° C. The particles then passed to a cooling zone operated at a temperature of 30° C. and were collected as free flowing granules.

The AOS granules had the following composition:

| | AOS granules A4 |
|---|---|
| Na AOS | 96 |
| Water | 2 |
| Sodium sulphate, NDOM | 2 |

Base powders F4 and F5 were prepared as described in Examples 6 and 7, using a Fukae batch granulator. These were mixed with PAS granules A2 as described in earlier Examples, or with AOS granules A4 as described above, to give full formulations within the invention.

| Ingredients wt %] | F4 | F5 |
|---|---|---|
| STP | 43.7 | 41.0 |
| Zeolite MAP | | 5.6 |
| NaLAS | 27.6 | 14.7 |
| NaLES[1] (as 100%) | | 7.1 |
| Sodium carbonate | 25.8 | 26.0 |
| Moisture, NDOM etc | 3.0 | 5.6 |

[1]sodium alkyl ether sulphate: Empicol (Trade Mark) 0251-70 ex Albright & Wilson, supplied as 70% paste

| Formulation | 8 | 9 |
|---|---|---|
| Base powder F4 | 65.3 | |
| Base powder F5 | | 69 |
| AOS granules A4 | 30 | |
| PAS granules A2 | | 27.7 |
| Granular sodium carbonate | 4.7 | 3.3 |
| Total surfactant (wt %) | 46.8 | 40.0 |
| Builder (wt %) | 29.3 | 33.3 |

-continued

| Formulation | 8 | 9 |
|---|---|---|
| Zeolite (wt %) | 0 | 3.9 |
| Surfactant:builder ratio | 1.6 | 1.2 |
| Bulk density [g/l] | 863 | 749 |
| Dynamic flow rate (ml/s) | 100 | 100 |

We claim:

1. A free-flowing built particulate laundry detergent composition comprising at least two different granular components:

(A) the first granular component selected from the group consisting of (a1) surfactant granules comprising a surfactant and, optionally, a builder; and (a2) builder granules comprising a builder and, optionally, a surfactant; and (B) the second granular component which is a spray-dried or granulated detergent base powder comprising 5–30%, by weight of the powder, of a surfactant selected from the group consisting of anionic surfactant, nonionic surfactant, and mixtures thereof and at least 50%, by weight of the powder, of a builder;

wherein alkali metal aluminosilicate is present in an amount of not more than 7% by weight, and the total content of a non-soap surfactant in the composition is at least 27% by weight, with the weight ratio of the total non-soap surfactant to the total builder is at least 1.2:1, provided that alkali metal carbonates and soluble alkali metal silicates are not taken into account when calculating the surfactant to builder weight ratio.

2. A detergent composition as claimed in claim 1, which contains at least 28% by weight of the total non-soap surfactant.

3. A detergent composition as claimed in claim 1, which contains at least 30% by weight of the total non-soap surfactant.

4. A detergent composition as claimed in claim 1, which contains at least 35% by weight of the total non-soap surfactant.

5. A detergent composition as claimed in claim 1, which contains from 27 to 50% by weight of the total non-soap surfactant.

6. A detergent composition as claimed in claim 1, having a dynamic flow rate of at least 100 ml/s.

7. A detergent composition as claimed in claim 6, having a dynamic flow rate of at least 110 ml/s.

8. A detergent composition as claimed in claim 1, wherein the builder is selected from the group consisting of inorganic phosphates, di- and tricarboxylic acid salts, polymeric polycarboxylates, layered silicates and combinations thereof.

9. A detergent composition as claimed in claim 8, wherein the builder (ii) is selected from the group consisting of sodium tripolyphosphate, citrate, acrylate or acrylate/maleate polymer, and combinations thereof.

10. A detergent composition as claimed in claim 1, which contains at least 15% by weight, in total, of the builder.

11. A detergent composition as claimed in claim 1, wherein the weight ratio of the surfactant to the builder is at least 1.5:1.

12. A detergent composition as claimed in claim 1, wherein the surfactant comprises anionic surfactant, nonionic surfactant or a combination thereof.

13. A detergent composition as claimed in claim 12, wherein the surfactant comprises anionic and nonionic surfactants in a weight ratio of at least 1:1.

14. A detergent composition as claimed in claim 1, wherein the surfactant granules are selected from the group consisting of:

(a) granules containing at least 60% by weight of non-soap anionic surfactant, (b) granules containing at least 20% by weight of non-ionic surfactant.

15. A detergent composition as claimed in claim 14, wherein the nonionic surfactant granules (b) contain from 0 to 10% by weight of alkali metal aluminosilicate.

16. A detergent composition as claimed in claim 1, having a bulk density within the range of from 300 to 1000 g/l.

17. A detergent composition as claimed in claim 1, having a bulk density within the range of from 450 to 900 g/l.

* * * * *